United States Patent [19]

Omichi

[11] 4,000,542

[45] Jan. 4, 1977

[54] DEVICE FOR ADJUSTING THE LENGTH OF A WATCHBAND

[75] Inventor: Tokio Omichi, Tokyo, Japan

[73] Assignees: Kabushiki Kaisha Bambi; Kabushiki Kaisha Hattori, both of Japan

[22] Filed: Mar. 21, 1975

[21] Appl. No.: 560,701

[30] Foreign Application Priority Data

Apr. 4, 1974 Japan ..... 49-37796[U]

[52] U.S. Cl. ..... 24/71 J; 24/70 J; 24/265 WS; 224/4 D

[51] Int. Cl.[2] ..... A43C 11/00; A44B 21/00

[58] Field of Search ..... 24/71 J, 70 J, 265 B; 224/4 D, 28 W, 4 H; 59/80, 82

[56] References Cited

UNITED STATES PATENTS

| | | | |
|---|---|---|---|
| 1,617,954 | 2/1927 | Kreisler | 24/71 J |
| 1,626,139 | 4/1927 | Kraysler | 24/265 B |
| 1,701,339 | 2/1929 | Roy | 24/265 B |
| 1,739,464 | 12/1929 | Jones | 24/71 J |
| 1,739,688 | 12/1929 | Nelson | 24/71 J |
| 1,750,786 | 3/1930 | Roy | 59/80 |
| 1,766,477 | 6/1930 | Arbrust | 24/71 J |
| 2,417,289 | 3/1947 | Bisso | 59/80 |
| 2,702,451 | 2/1955 | Schwaibold | 24/265 B |
| 2,998,697 | 9/1961 | Augenstein | 59/82 |

FOREIGN PATENTS OR APPLICATIONS

| | | | |
|---|---|---|---|
| 256,629 | 8/1948 | Switzerland | 24/71 J |
| 278,356 | 1/1952 | Switzerland | 24/71 J |

*Primary Examiner*—Bernard A. Gelak
*Attorney, Agent, or Firm*—Robert E. Burns; Emmanuel J. Lobato; Bruce L. Adams

[57] ABSTRACT

A three-element device for adjusting the length of a watchband having a main link larger than other length-adjusting links of the device and the watchband which is connected to two foldable-elements of the device foldable over one another to define a closure. The three elements form a three-element fitting normally connected to intermediate ends of a watchband. The main link is easily connectable to the watchband and can be disconnected thereto to provide for insertion of similarly constructed shorter length-adjusting links. Each of the links has a top and sidewalls opposite each other that are provided with openings through which a spring-loaded pin is inserted through a connecting extension on each link that is insertable on the underside of an adjacent link so that the pin is received through this extension and links adjacent length-adjusting links of the device. The links may be provided with a leading tongue that limits the relative movement of the links.

4 Claims, 4 Drawing Figures

DEVICE FOR ADJUSTING THE LENGTH OF A WATCHBAND

BACKGROUND OF THE INVENTION

This invention relates generally to watchbands and more particularly to a device for adjusting the length of watchbands.

The lengthening of metal watchbands generally is a relatively complex problem requiring the adding of links to the watchband. Generally watchbands are made longer than necessary and then links are removed to adjust to a desired length. The removal of links generally requires special tools and is a relatively complex operation.

SUMMARY OF THE INVENTION

A principal object of the present invention is the provision of a device for readily adjusting the length of a watchband without the need of specialized tools.

The device according to the invention comprises a three-element fitting having a main link longer than other length-adjusting links of the watchband connected to one intermediate end of a watchband and two foldable elements on another intermediate end of the watchband pivotally connected to each other and to the main link which are foldable into an overlying position one over the other to define a closure. Provision is made for connecting the main link to the watchband to a removable connection consisting of a projection extending from the watchband to the link having a loop through which a spring loaded pin extends axially thereto and is received in opposed openings in sidewalls of the main link. The length of the watchband is adjusted or lengthened by removal of this connection of the main link to the watchband and inserting therebetween one or more other length-adjusting links constructed similarly to the main link as to the sidewalls and having slots therethrough and provided with a projection or connecting extension that is insertable underlying the next adjacent link with a loop for the corresponding spring-loaded pin that is received in the opposed openings of the next adjacent link.

BRIEF DESCRIPTION OF THE DRAWINGS

Other objects and advantages of the device for lengthening a watchband will appear from the following description of an example of the invention, and the novel features will be particularly pointed out in the appended claims and attached drawings in which:

DESCRIPTION OF THE PREFERRED EMBODIMENT

Figure 1:
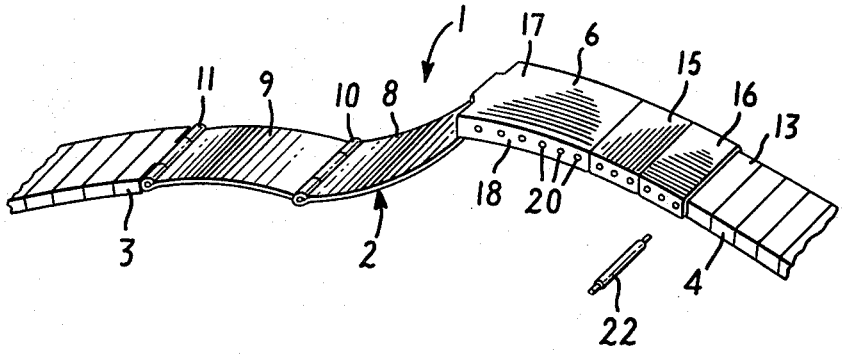
FIG. 1 is a fragmentary perspective view of a watchband provided with a device for lengthening thereof according to the invention.
Figure 2:
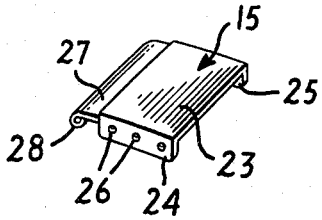
FIG. 2 is a perspective view of one embodiment of a length-adjusting link for lengthening the watchband.

As illustrated in the drawings a watchband 1 is illustrated as having a length-adjusting device 2 connected intermediate opposite ends 3, 4 of a watchband. The length-adjusting device 2 is a three-element fitting which comprises a main link 6 to which is pivotally connected a two-element closure consisting of a foldable element 8 foldable over another element 9 pivotally connected to the first-mentioned element 8 through a pivot connection 10. The second foldable element is connected to the watchband through a pivotal connection 11.

The main link 6 of the three-element fitting 2 is usually connected to an end link 13 of a watchband while the three-element is connected to the opposite end to a link 15 of the watchband. The watchband is constructed of links of the type of a desired type construction. The main link 6 is connected to the watchband link 13 similarly to a connection for two length-adjusting links 15, 16 which are insertable into the watchband for lengthening thereof as hereinafter described.

The main link 6 of the three-element fitting 2 has a top 17 and sidewalls 18 extending the full length of the top of the main link. These sidewalls are provided with opposed openings 20 on the opposite sidewalls for receiving a spring-loaded pin 22 therein for connecting the length-adjusting links thereto.

Figure 3:
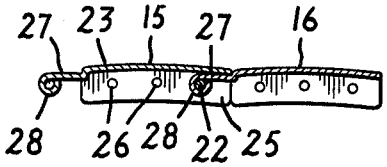
FIG. 3 is a side elevation section view of two length-adjusting links of the type shown in FIG. 2 and connected to each other.

The length-adjusting links 15, 16 are constructed similarly to the main link. For example, the link 15 has a top 23 and sidewalls 24, 25 opposite one another and provided with a plurality of openings 26 for effecting a connection to adjoining length-adjusting links as hereinafter described. A leading projection or connection extension 27 offset from the top as shown in FIG. 3, extends from the top and has a fold 28 to define therein a channel or loop for receiving a spring-loaded pin such as the pin 22 so that the pin extends into opposite openings of the sidewalls of the main link. Furthermore, the next sequential length-adjusting link 16 is similarly constructed and is pivotally connected to the adjacent and advanced length-adjusting link 15 in a similar manner. The offset of the individual projections 27 of these links is such that the tops of the links are flush as shown in FIG. 3.

Figure 4:
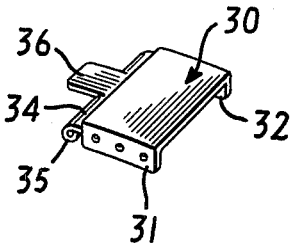
FIG. 4 is a perspective view of a second embodiment of a length-adjusting link connectable to the device illustrated in FIG. 1.

A second type of length-adjusting link 30 is shown in FIG. 4. This link has opposite sidewalls 31, 32 in a manner similar to the other length-adjusting links and is provided with a leading projection 34 or connection extension with a fold 35 defining two loops laterally spaced therein. From this projection extends a tongue 36 that underlies the link to which this link is connected and is disposed between the underside of the link to which it is connected and between this underside and a spring-loaded pin extending through the loops when in an assembled state so that it limits the relative pivotal movement of the connected length-adjusting links.

As indicated before the watchband and the link 30 is connected to the main link by a structure similar to the length-adjusting links described above. The other links of the watchband may be connected to each other in any desirable manner.

It can thus be seen that the length-adjusting device provides for an easy construction for lengthening a watchband. Watchbands can be made of a given length and then readily be adjusted to suit the user when the watchband is adjusted for the wrist size of the user. It is, of course, understood that the watch to which the wristband is attaches is not shown and it is connected at opposite ends, not shown, of the watchband.

Those skilled in the art will understand that while the drawings illustrate two length-adjusting links as being used actually several, one or more than two, such links may be used for adjusting the length of a watchband.

What I desire to secure and claim for Letters Patent:

1. A device for adjusting the length of a watchband comprising, a three-element fitting connectable intermediate two opposite ends of a watchband comprising a main link on one end of said fitting longer than other links of a watchband to which said three-element fitting is attached and two-foldable elements foldable over one another and positionable underlying the main link to jointly therewith define a closure for the watchband, means pivotally connecting the two-foldable elements, means for pivotally connecting an end one of said two-foldable elements to an end of a watchband, means for pivotally connecting the other of the two-foldable elements to said main link, said main link having a top the length of the main link and two parallel sidewalls opposite one another extending along the side of said top, said sidewalls having two opposed openings for receiving a spring-loaded pin from the underside of said main link, at least one length-adjusting link shorter in length than said main link, said length-adjusting link having a top of equal width to the top of said main link and two opposed sidewalls similar in configuration to the walls of said main link and having axially spaced openings for receiving a spring-loaded pin extending between the two sidewalls on an underside of said top, a spring-loaded pin positionable in use extending between said two sidewalls underneath said top, said end of said watchband to which said length-adjusting link is connected in use comprising an end link having an end loop through which said spring-loaded pin extends and is received in opposed openings on said sidewalls releasably linking said end link and said length-adjusting link, said length-adjusting link having a connection extension extending offset from said top for underlying said top of said main link when in assembled state therewith, said extension having two laterally spaced loops positionable in alignment with opposed openings in the sidewalls of said main link, a second spring-loaded pin for extending through the last-mentioned loops and releasably received in use in said last-mentioned opposed openings thereby for releasably connecting said main link and said length-adjusting link, said extension having a tongue extending forwardly of said loops for underlying said main link and disposed in said assembled state between the underside of the top of said main link and said second spring-loaded pin to preclude relative pivotal movement therebetween, and said offset being dimensioned so that said top of said main link overlies said extension and the top of said main link and said top of said length-adjusting link are flush in said assembled state, whereby in said assembled state said sidewalls of said length-adjusting link and said main link are aligned and abutting and said length adjusting link is a rigid extension of said main link.

2. A device for adjusting the length of a watchband according to claim 1, including a second length-adjusting link constructed exactly the same as the first-mentioned length-adjusting link and having a top, sidewalls, and extension with two loops having a tongue therebetween, a third spring-loaded pin connecting said first-mentioned length-adjusting link and said second length-adjusting link, the tongue on said second length-adjusting link being disposed underlying the underside of the top of second length-adjusting link and disposed between the last-mentioned top underside and said third spring-loaded pin to preclude relative movement between said first-mentioned length-adjusting link and said second length-adjusting link.

3. In combination, a watchband having a plurality of alike links, means for pivotally connecting adjacent ones of said links; a device for adjusting the length of said watchband comprising, a three-element fitting connected intermediate two opposite ends of said watchband comprising a main link on one end of said fitting longer than other links of said plurality of links of said watchband to which said three-element fitting is attached and two-foldable elements foldable over one another and positionable underlying the main link to jointly therewith define a closure for the watchband, means pivotally connecting the two-foldable elements, means for pivotally connecting an end one of said two-foldable elements to an end link of said watchband, means for pivotally connecting the other of the two-foldable elements to said main link, said main link having a top the length of the main link and two parallel sidewalls opposite one another extending along the sides of said top, said sidewalls having two opposed openings for receiving a spring-loaded pin from the underside of said main link, at least one length-adjusting link shorter in length than said main link, said length-adjusting link having a top of equal width to the top of said main link and two opposed sidewalls similar to the walls of said main link and having axially spaced openings for receiving a spring-loaded pin extending between the two sidewalls on an underside of said top, a spring-loaded pin positionable in use extending between said two sidewalls underneath said top, said end of said watchband to which said length-adjusting link is connected comprising an end link having an end loop through which said spring-loaded pin extends and is received in opposed openings on said sidewalls releasably linking said end link and said length-adjusting link, said length-adjusting link having a connection extension extending offset from said top for underlying said top of said main link, said extension having two laterally spaced loops positionable in alignment with opposed openings in the sidewalls of said main link, a second spring-loaded pin extending through the last-mentioned loops and releasably received in use in said last-mentioned opposed openings thereby releasably connecting said main link and said length-adjusting link, said extension having a tongue extending forwardly of said loops for underlying said main link and disposed between the underside of the top of said main link and said second spring-loaded pin to preclude relative pivotal movement therebetween, and said offset being dimensioned so that said top of said main link overlies said extension and the top of said main link and said top of said length-adjusting link are flush, whereby the sidewalls of said length-adjusting link and the sidewalls of said main link are aligned and said length-adjusting link is a rigid extension of said main link.

4. A device for adjusting the length of a watchband comprising, a three-element fitting and at least one length-adjusting link connectable intermediate two opposite ends of a watchband, said three-element fitting comprising a main link on one end of said fitting longer than other links of a watchband to which said three-element fitting is attached and two-foldable elements foldable over one another and positionable underlying the main link to jointly therewith define a closure for the watchband, means pivotally connecting the two-foldable elements, means for pivotally connecting an end one of said two-foldable elements to an end of a watchband, means for pivotally connecting the other of the two-foldable elements to said main link, said main link having a top the length of the main link and two parallel sidewalls opposite one another extending along the sides of said top, said sidewalls having two opposed openings for receiving a spring-loaded pin from the underside of said main link, said length-adjusting link comprising a link shorter in length than said main link constructed similarly thereto, said length-adjusting link having a top of equal width to the top of said main link and two opposed sidewalls similar in configuration to the walls of said main link and having axially spaced openings for receiving a spring-loaded pin extending between the two sidewalls on an underside of said top, a spring-loaded pin positionable in use extending between said two sidewalls underneath said top, said end of said watchband to which said length-adjusting link is connected in use comprising an end link having an end loop through which said spring-loaded pin extends and is received in opposed openings on said sidewalls releasably linking said end link and said length-adjusting link, said length-adjusting link having a connection extension extending offset from said top for underlying said top of said main link when in assembled state therewith, said extension having a loop positionable in alignment with opposed openings in the sidewalls of said main link, a second spring-loaded pin for extending through the last-mentioned loop and releasably received in use in said last-mentioned opposed openings thereby for releasably connecting said main link and said length-adjusting link, said extension having a surface for underlying said main link and disposed in said assembled state between the underside of the top of said main link and said second spring-loaded pin to preclude relative pivotal movement therebetween, and said offset being dimensioned so that said top of said main link overlies said extension and the top of said main link and said top of said length-adjusting link are flush in said assembled state, whereby in said assembled state said sidewalls of said length-adjusting link and said main link are aligned and abutting and said length adjusting link is a rigid extension of said main link.

* * * * *